US008303783B2

(12) United States Patent
Therkildsen

(10) Patent No.: US 8,303,783 B2
(45) **Date of Patent: *Nov. 6, 2012**

(54) METHOD AND APPARATUS FOR IMPROVING CORROSION RESISTANCE OF CHROME PLATED MATERIAL

(75) Inventor: Charles G. Therkildsen, Barrington, IL (US)

(73) Assignee: Industrial Hard Chrome, Ltd., Geneva, IL (US)

( * ) Notice: Subject to any disclaimer, the term of this patent is extended or adjusted under 35 U.S.C. 154(b) by 261 days.

This patent is subject to a terminal disclaimer.

(21) Appl. No.: 12/652,352

(22) Filed: Jan. 5, 2010

(65) Prior Publication Data

US 2010/0101488 A1 Apr. 29, 2010

Related U.S. Application Data

(63) Continuation of application No. 11/034,790, filed on Jan. 13, 2005, now Pat. No. 7,641,782, and a continuation of application No. 10/099,518, filed on Mar. 15, 2002, now abandoned, and a continuation-in-part of application No. 09/969,940, filed on Oct. 3, 2001, now Pat. No. 6,808,751.

(51) Int. Cl.

| | |
|---|---|
| ***C25D 7/04*** | (2006.01) |
| ***C25D 17/00*** | (2006.01) |
| ***B05B 13/02*** | (2006.01) |
| ***B05B 5/00*** | (2006.01) |

(52) U.S. Cl. . 204/275.1; 118/307; 118/67; 118/DIG. 11

(58) Field of Classification Search ..... None
See application file for complete search history.

(56) References Cited

U.S. PATENT DOCUMENTS

| | | | |
|---|---|---|---|
| 3,612,743 | A | 10/1971 | Angele |
| 3,616,287 | A | 10/1971 | Drahicescu et al. |
| 3,625,039 | A | 12/1971 | Kubach et al. |
| 3,642,586 | A | 2/1972 | Shepard et al. |
| 3,661,732 | A | 5/1972 | Withrow |
| 3,685,208 | A | 8/1972 | Richter |
| 3,691,029 | A | 9/1972 | Raymond et al. |
| 3,701,677 | A | 10/1972 | Mlyata et al. |
| 3,720,596 | A | 3/1973 | Draghicescu et al. |
| 3,751,344 | A | 8/1973 | Angelini |
| 3,754,976 | A | 8/1973 | Babecki et al. |
| 3,843,495 | A | 10/1974 | Malak |

(Continued)

FOREIGN PATENT DOCUMENTS

| | | |
|---|---|---|
| JP | 09071893 | 3/1997 |

*Primary Examiner* — Harry D Wilkins, III
(74) *Attorney, Agent, or Firm* — Greenberg Traurig, LLP; Richard D. Harris

(57) ABSTRACT

A method and apparatus for improving the corrosion resistance of chrome plated materials. After the materials to be chrome plated are mechanically abrasively polished, but before they are reverse etched, they are power washed with a high-pressure liquid. A sprayer with nozzles directed inwardly towards the materials directs water onto the material at pressures in the range of 1000 or 2500 to 3000 psi. After the materials are chrome plated, they are heated above the melting point of a buffing compound, and then the heated materials with the buffing compound applied are buffed. An induction heater is used, before or after the buffing compound is applied. Computer controls, responsive to operator input of the cross-sectional size, composition and/or speed of movement of the chrome plated materials, to in turn regulate the power to an induction coil heater.

9 Claims, 2 Drawing Sheets

U.S. PATENT DOCUMENTS 3,844,760 A 10/1974 Nelson
3,847,760 A 11/1974 Malak
3,852,170 A 12/1974 Angelinl
3,888,693 A 6/1975 Schevey et al.
3,904,346 A 9/1975 Shaw et al.
3,951,682 A 4/1976 Schevey et al.
3,977,839 A 8/1976 Paislin, Jr.
4,065,365 A 12/1977 Ibarguengoitia
4,111,763 A 9/1978 Pryor
4,414,037 A 11/1983 Feidheim
4,654,089 A 3/1987 Singelyn et al.
4,746,414 A 5/1988 Carpenter et al.
4,781,806 A 11/1988 Tenace et al.
4,817,342 A 4/1989 Martin et al.
4,962,776 A * 10/1990 Liu et al. ..... 134/11
5,139,039 A 8/1992 Yates
5,188,135 A 2/1993 Neumann et al.
5,271,823 A 12/1993 Schachameyer et al.
5,306,531 A 4/1994 Laurence et al.
5,374,346 A 12/1994 Bladon et al.
5,401,379 A 3/1995 Mazzochi
5,480,536 A 1/1996 Suehiro et al.
5,749,773 A 5/1998 Tabata
6,039,860 A 3/2000 Cooper et al.
6,224,463 B1 5/2001 Hartzell, Jr.
6,311,538 B1 11/2001 Martin

* cited by examiner

METHOD AND APPARATUS FOR IMPROVING CORROSION RESISTANCE OF CHROME PLATED MATERIAL

This application is a continuation of U.S. Ser. No. 11/034,790, filed Jan. 13, 2005 and presently pending, which, in turn, is a continuation of U.S. Ser. No. 10/099,518, filed Mar. 15, 2002 and now abandoned, which, in turn, was a continuation-in-part of U.S. Ser. No. 09/969,940, filed Oct. 3, 2001, now U.S. Pat. No. 6,808,751 for a Method for Improving Corrosion Resistance of Chrome Plated Material.

BACKGROUND OF THE INVENTION

1. Field of the Invention

The present invention is directed to preparing materials for chrome plating and to finishing chrome plated materials, and in particular, to methods and apparatus for improving the corrosion resistance of chrome plated materials.

2. The Prior Art

Materials are chrome plated to reduce surface corrosion of the materials. Nevertheless, despite the chrome plating, surface corrosion still occurs and presents problems. This is particularly true in applications where there is intimate contact between the surface of the chrome plated materials and another material. Thus, for example, chrome plated rods used in hydraulic applications come into contact with seals made of rubber and similar materials. Surface corrosion of such rods has the additional disadvantage of causing accelerated wear of the seals. In use, such rods are subjected to high temperatures during operation of the equipment in which they are used, which increases the occurrence of corrosion.

In order to improve the corrosion resistance of chrome plated rods and the like, they are subjected in the prior art to a polishing process. A chrome plated rod is advanced along a line from an entrance end upon a series of pairs of offset rollers that both rotate and advance the rod from the entrance end to the exit end of the line. Generally, after the rod is placed on the offset conveying rollers, the periphery of the chrome plated rod is initially subjected to wet abrasive polishing at one or more polishing stations. After such wet abrasive polishing, a buffing compound, of any of a selected one of a number of commercially available mixtures, is applied to the rotating chrome plated rod. Usually such buffing compounds are applied in a multi-phase mixture by spraying them onto the rotating and advancing rod.

The prior art process then subjects the rod, with the buffing compound applied, to a series of buffing steps at a number of buffing stations. Generally, three buffing stations are used in the prior art to provide the required amount of polishing or buffing to sufficiently drive the buffing compound into the micro cracks in the chrome plated surface. Thus, open micro cracks in the chrome plated surface are sealed against corrosion by the impregnated buffing compound.

In such prior art processes, as the compound treated chrome plated surface is subjected to more polishing or buffing, it results in a higher surface finish. Thus, in the prior art process of improving the corrosion resistance of chrome plated materials, there is a corollary between the degree of surface finish and the expected resultant corrosion resistance. However, particularly in hydraulic applications, there is a disadvantage to having too high of a surface finish as it impedes the effectiveness of the cooperating seals. Nevertheless, if the corrosion resistance of the chrome plated rods is not significantly improved by an application of a buffing compound, there will be a resulting increase in downtime of production of the hydraulic equipment while the corroded rods and/or the ruined seals need to be replaced.

The effective corrosion resistance provided by the chrome plating of materials is also effected by the preparation of the materials to be chrome plated. Thus, as the chrome plated materials, such as rods, are subjected in the prior art to a polishing process after they are chrome plated, the rods are also subjected to a polishing process prior to chrome plating. A line like that used for advancing the chrome plated rod is also used for advancing the rods to be chrome plated. Accordingly, a rod to be chrome plated is advanced along a line from and entrance end upon a series of pairs of offset rollers that both rotate and advance the rod from the entrance end to the exit end of the line. Generally, after the rod is placed on the offset conveying rollers, the periphery of the rod to be chrome plated is subjected to abrasive polishing at one or more polishing stations. Usually, the material to be chrome plated is subjected to a series of abrasive polishing steps in which the abrasive or grit used to polish will vary to produce a smoother finish as the material to be chrome plated advances from the entrance end toward the chrome plating.

After the rod is abrasively polished in the prior art process, it is immersed in a caustic solution cleaning tank and generally then subsequently immersed in one or more rinse tanks before being subjected to plating. In the prior art, normally the first plating step after the rod is abrasively polished and cleaned is reverse etching, prior to the actual chrome plating of the rod.

Generally, all other things being equal, the smoother the finish of the material to be chrome plated, the better will be the corrosion resistance provided by the chrome plating. Unfortunately, the abrasive polishing of the material to be chrome plated generally leaves strands, filaments or "fine hairs" of microscopic size. Such "fine hairs" are measured in microns, and their size varies as a result of the particular belt or wheel used to abrasively polish the material to be chrome plated. The presence of such "fine hairs" when the material to be chrome plated is reverse etched results in micro cavities wherever the "fine hairs" are present, which detrimentally affects the resulting corrosion resistance provided by the chrome plating. To the extent that such micro cavities or pockets can be eliminated prior to chrome plating, the effective corrosion resistance will be improved.

Accordingly, it would be desirable to provide a method and apparatus for improving the corrosion resistance of chrome plated materials, in order to increase the life of such materials and to decrease the downtime of machines in which they are used.

These and other desirable characteristics of the present invention will become apparent in light of the present specification, including claims, and drawings.

SUMMARY OF THE INVENTION

The present invention is directed, in part, to an apparatus for improving the corrosion resistance of chrome plated materials. The apparatus comprises a line for receiving and processing materials to be chrome plated. The line has an entrance at one, entrance end, and an exit at another, exit end, opposed to the one entrance end. The apparatus further comprises a mechanism for moving the received materials to be chrome plated along the line from the one entrance end to the other exit end during processing, at least one mechanical device intermediate the one entrance end and the other exit end for abrasively polishing the materials to be chrome plated, at least one station intermediate the at least one mechanical device and the other exit end for plating the materials to be chrome plated, and at least one high-pressure liquid sprayer for power washing the materials to be chrome plated intermediate the at least one mechanical device and the at least one station for plating the materials to be chrome plated.

The at least one station for chemically treating the materials to be chrome plated is a reverse etching station.

At least one caustic solution station for treating the materials to be chrome plated, is positioned intermediate the at least one high-pressure liquid washer and the reverse etching station as the materials to be chrome plated move from the one entrance end to the other exit end.

The liquid is water. The pressure is greater than 100 psi.

The pressure is in the range of 1000 to 3000 psi, or 2500 to 3000 psi.

The at least one high-pressure liquid sprayer has a pair of opposed nozzles that are directed towards each other, or a plurality of nozzles that are inwardly directed towards the materials to be chrome plated.

The apparatus further comprises a chrome plating station in which the materials to be chrome plated are chrome plated and become chrome plated materials, an applicator intermediate the one entrance end and the other exit end for applying a buffing compound to said chrome plated materials, a heater for heating both the chrome plated materials and the buffing compound, and at least one buffer for collectively buffing the heated chrome plated materials and the buffing compound.

The present invention is also directed, at least in part, to a method for improving the corrosion resistance of chrome plated materials comprising the steps of:

abrasively polishing the materials to be chrome plated;

plating the materials to be chrome plated; and power washing the abrasively polished materials to be chrome plated with a high pressure liquid spray before plating the materials to be chrome plated.

In the method of the present invention, the plating step is reverse etching of the material to be chrome plated.

The method of the present invention also includes a step of cleaning the material to be chrome plated with a caustic solution before the reverse etching step.

In the method of the present invention the step of cleaning the material to be chrome plated with a caustic solution is performed after the power washing step.

In the method of the present invention the step of power washing is accomplished by spraying water at a pressure greater than 100 psi onto the materials to be chrome plated.

In the method of the present invention the step of power washing is accomplished by spraying liquid at a pressure in the range of 1000 to 3000 psi onto the materials to be chrome plated through a plurality of nozzles directed inwardly towards the materials to be chrome plated.

In the method of the present invention the step of power washing is accomplished by spraying liquid at a pressure in the range of 2500 to 3000 psi onto the materials to be chrome plated through a plurality of nozzles directed inwardly towards the materials to be chrome plated.

The method of the present invention also includes a step of advancing the materials to be chrome plated along at least a portion of a processing line extending from one entrance end to an opposed exit end, with the steps of abrasively polishing the materials to be chrome plated, plating the materials to be chrome plated, and power washing the abrasively polished materials to be chrome plated with a high pressure liquid spray all being performed at discrete intervals along the line from said one entrance end to said opposed exit end.

The method of the present invention further includes the steps of chrome plating the materials to be chrome plated so that they become chrome plated materials, applying a buffing compound to the chrome plated materials, heating the chrome plated materials, and buffing the heated chrome plated materials after the buffing compound has been applied.

DETAILED DESCRIPTION OF THE DRAWINGS

Figure 1:
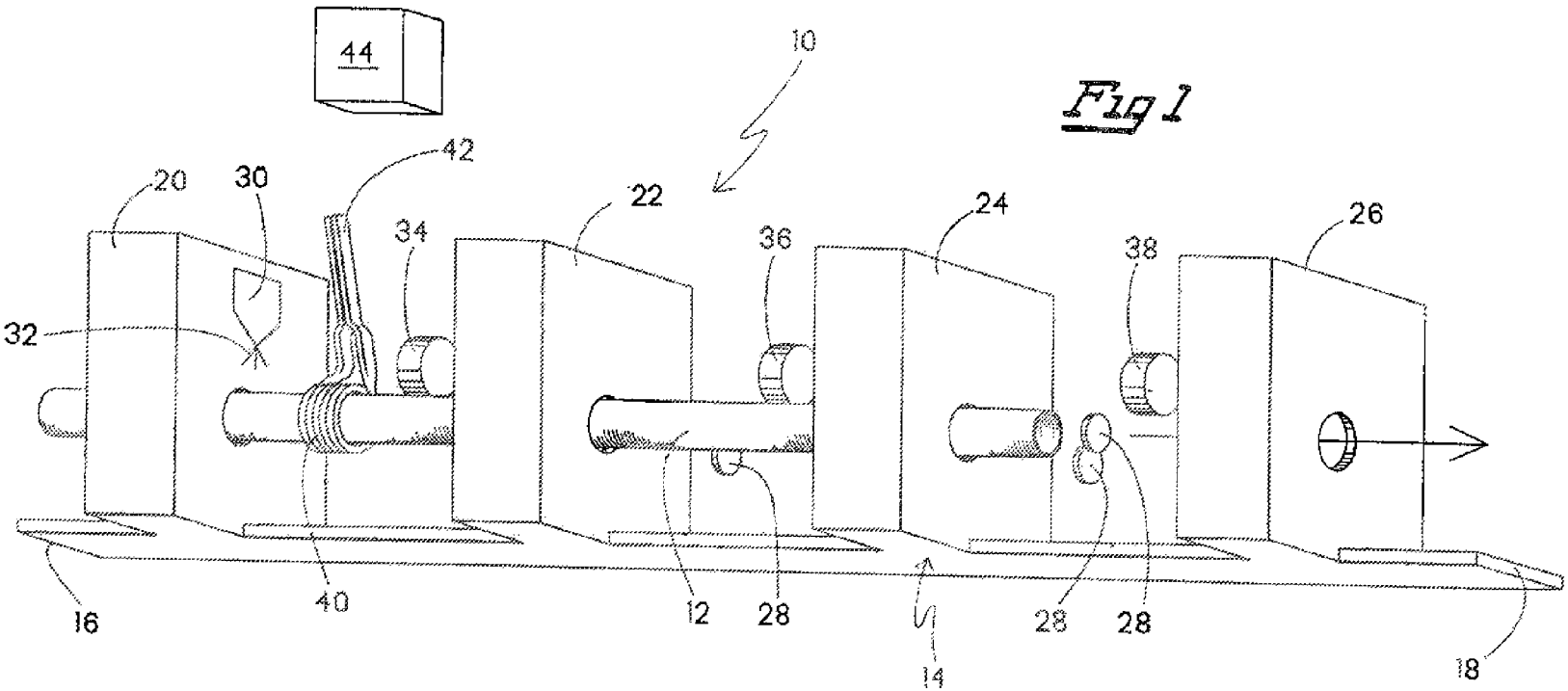
FIG. 1 is a perspective, schematic illustration of a portion of an apparatus according to the present invention, and which may be used for practicing the method of the present invention.

While this invention is susceptible of embodiment in many different forms, there is shown in the drawings and will be discussed herein in detail, a particular embodiment of the invention, with the understanding that the present disclosure is intended to be 5 considered as an exemplification of the principles of the invention and is not intended to limit the invention to the embodiment illustrated.

FIG. 1 is a perspective, schematic illustration of part of an apparatus 10 for improving the corrosion resistance of chrome plated rods. More particularly, FIG. 1 illustrates that portion of a line 14 in which a chrome plated rod 12 has a buffing compound 32 applied by spraying onto the rod 12, which is being both advanced and rotated. For ease of illustration, portions of line 14, as they would generally exist in a commercial environment, have been omitted. Thus, it will be appreciated by those skilled in the art that, prior to what has been designated as the one entrance end 16, there will be another portion of the line which initially receives chrome plated rod 12 and advances it through a series of wet abrasive polishing stations. Such wet abrasive polishing stations are conventional in the prior art processes and accordingly are omitted from this illustration. Similarly, it will also be appreciated by those skilled in the art that, beyond what has been designated as the other exit end 18 in FIG. 1, there is another portion of the line upon which the chrome plated rod is received for cooling and inspection after being advanced through the portion of the line illustrated in FIG. 1.

Chrome plated rod 12 is placed upon a series of pairs of offset driven rollers 28, which both rotate rod 12 and advance it through line 14 from the one entrance end 16 through to the other exit end 18. Again, for ease of illustration, most of such rollers 28 have been omitted from FIG. 1. The number of rollers required, their structure, arrangement and driving mechanisms are known to those skilled in the art.

The embodiment of the apparatus, and the method practiced using the apparatus, as illustrated in FIG. 1, includes three stations, which are defined along line 14 by the four housing sections 20, 22, 24 and 26. These housing sections conveniently enclose portions of the conventional drive mechanisms (not shown) that are used in the prior art for the rotating, advancing and polishing of chrome plated rod 12.

After rod 12 is advanced through the wet polishing stations (not shown), it passes through housing section 20. Either within housing section 20, or as illustrated in FIG. 1, upon exit from housing station 20, an applicator 30 applies a buffing compound 32. The buffing compound may be selected from any of a number of commercially available buffing compounds, which have been used in the prior art processes. The buffing compound may be applied as a solid, or as illustrated in FIG. 1, as a liquid by a spray applicator. Although the buffing compound may be referred to as a liquid, it is more correctly a multi-phase mixture that includes solids in liquid media, if it is not a solid at time of application. Each of the buffing compounds, more specifically the solids of the buffing compounds, has a melting point. Mostly, such melting points are below 160° F.

In the present invention, as illustrated in FIG. 1, after the buffing compound is applied to the rod, both the rod and the buffing compound pass through an induction heating coil. As an alternative embodiment, the rod could pass through the induction heating coil 40, and the buffing compound 32 could then be applied. As a further embodiment, the heater need not be a coil, nor even be an induction heater. Conduction and/or convection heaters may be used to achieve a 160° F. temperature of the chrome plated material, although they may require a greater time and/or distance to properly heat the chrome plated material.

Induction coil 40 is connected through suitable conductors 42 to a power source (not shown). In addition, induction coil 40 is connected to a computer controller 44 which regulates the power to induction coil 40 for heating rod 12 to a temperature above the melting point of the buffing compound used. In a particular embodiment of the present invention, a temperature of 160° F. has been used to melt buffing compound 32. In addition, it is believed that heating rod 12 to the 160° F. temperature causes any microcracks in the periphery of rod 12 to open up, facilitating impregnating them with buffing compound 32. Of course, as rod 12 cools, such microcracks then tend to close up, capturing the impregnating compound.

In order to facilitate operation in a commercial environment, computer controller 44 may be programmed by conventional programming methods to regulate the amount of power to induction coil 40 for achieving the desired temperature of rod 12, in response to operator input of one or more factors, such as the speed of movement, composition of the chrome plated materials and size of the chrome plated material being processed, such as the diameter of a rod.

After rod 12 has had buffing compound 32 applied, and after rod 12 is heated to a temperature above the melting point of buffing compound 32, which may occur in the sequence illustrated in FIG. 1, or in the reverse sequence (not shown), the heated rod and buffing compound are subjected to buffing. Thus, within the station of line 14, between housing sections 20 and 22, a rotating buffing wheel 34 engages rod 12 in a conventional manner. One or more additional subsequent buffing steps may also be used, such as at the station between housing sections 22 and 24 where rotating buffing wheel 36 buffs the heated rod and buffing compound, as well as possibly at the station illustrated between housing sections 24 and 26, where rotating buffing wheel 38 buffs rod 12 and buffing compound 32 may be employed. The present invention does, however, allow for reducing the degree of surface finish, if desired, while still obtaining a significant improvement in the corrosion resistance of the chrome plated material. In addition, buffing compounds having a wider range of melting points, which may be desirable in particular hydraulic applications, may be readily accommodated by varying the computer controlled heater input.

As will be apparent from the foregoing description, and the illustration of FIG. 1, the present invention provides an apparatus for practicing a method for improving corrosion resistance of chrome plated material. Thus, chrome plated material, such as rod 12, is subjected to the steps of applying a buffing compound 32, either as a solid, or a liquid using sprayer 30, heating rod 12 to a temperature of approximately 160° F., a temperature above the melting point of buffing compound 32, and then subjecting the heated rod and applied buffing compound to at least one buffing wheel, before the rod cools down significantly. Thus, if rod 12 is heated to 160° F., the buffing is accomplished while the rod is at approximately 140° F. Generally, an acceptable standard of corrosion resistance using the prior art process was forty-eight hours in an ASTM 8117 salt spray test. With the apparatus and method described above, ASTM 8117 salt spray test results of seventy-two hours, and longer, have been routinely obtained.

Figure 2:
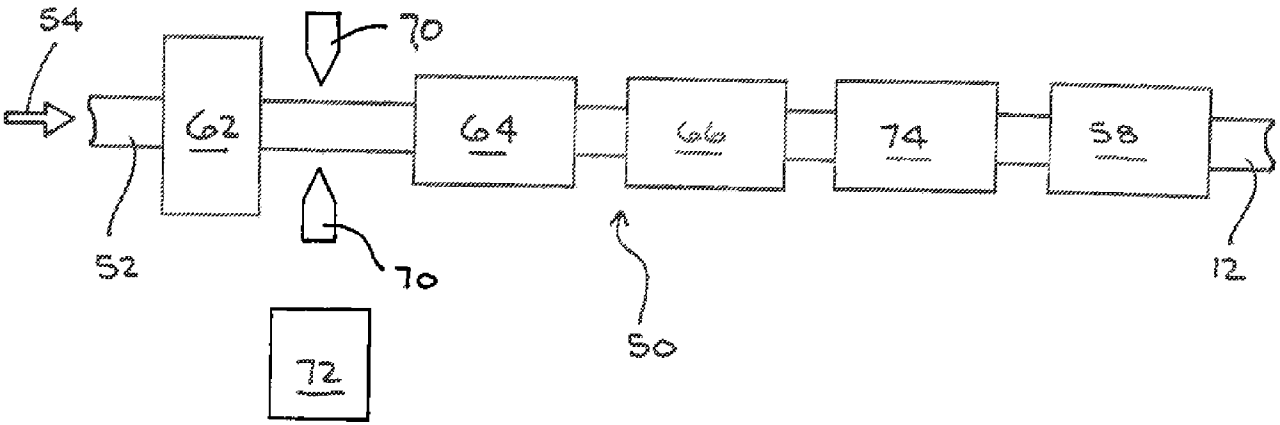
FIG. 2 is a schematic illustration of another portion of the apparatus according to the present invention, and which may be used for practicing the method of the present invention.

FIG. 2 is a schematic illustration of another part of apparatus 10 for further improving the corrosion resistance of chrome plated rods. More particularly, FIG. 2 illustrates a portion 50 of line 14 in which the material, in the form of a rod 52, that is to become chrome plated rod 12, is prepared for chrome plating. Prior to the portion of a line 14 illustrated in FIG. 1, the material 52 to be chrome plated enters the earlier portion 50 of the line at an earlier entrance end 54. A series of pairs of offset driven rollers 28, like those illustrated in FIG. 1, both rotate the rod 52 and advance it through the portion 50 of the line from the earlier entrance end 54 through to a chrome plating station 58 and then through the previously described series of wet abrasive stations and then through the portion 14 illustrated in FIG. 1 through to the other exit end 18.

The embodiment of the apparatus, and the method practiced using the apparatus, as illustrated in FIG. 2 includes a number of polishing stations, which are for convenience of illustration shown in FIG. 2 by the single, last polishing station 62. Such polishing stations are conventional in the art and generally include a series of abrasive polishing belts or wheels of decreasing grit size in order to produce an ever increasingly smoother finish of the material to be plated. As in the prior art, after the rod 52 that is to be chrome plated is subjected to the abrasive polishing, it may be immersed in a caustic solution cleaning tank 64. After that, it may be immersed in one or more rinse tanks, which for convenience of illustration are indicated by the single rinse tank 66 in FIG. 2.

However, in the present invention, as illustrated in FIG. 2, after the abrasive polishing 62, rod 52, preferably prior to being immersed in the caustic solution cleaning tank 64 and the rinse tank(s) 66, is subjected to a power washer or power sprayer 70.

Cleaning of the abrasively polished rod 52, whether by immersion or spraying at standard pressure, does not remove the "fine hairs". Water is generally received from a municipality, or other such source, at a standard pressure of approximately 40 psi. In order to accomplish the desired effect of removing the microscopic sized "fine hairs" of the material, it is necessary to subject it to a high-pressure power wash of at least 100 psi. Indeed, it has been found preferable to subject the material to be chrome plated to a power wash in the range of 1000 to 3000 psi, and even to a higher pressure range of 2500 to 3000 psi.

Water has been found to be an effective medium for the power washing step, although other liquids may also be usable. Thus, it is possible that a liquid including a caustic solution might obviate the need for immersion in a caustic solution cleaning tank, such as 64. In any event, it is desirable to recirculate the power washing liquid. Such recirculation is accomplished by conventional techniques for the recirculation of water and other liquids used in other plating plant processing steps, and is illustrated in FIG. 2 as the recirculation system 72.

After the rod 52 is abrasively polished and power washed, and possibly immersed in a caustic solution cleaning tank 64 and rinse tanks 66, it is subjected to a first plating step, more particularly, it is reverse etched at station 74. Then rod 52 is chrome plated at station 58. Reverse etching 74 is accomplished using apparatus and methods well known in the chrome plating art, as is the chrome plating 58 itself. Once chrome plated, rod 52 becomes the chrome plated rod 12 illustrated in FIG. 1, it is then processed as illustrated and previously described to further enhance its corrosion resistance.

Figure 3:
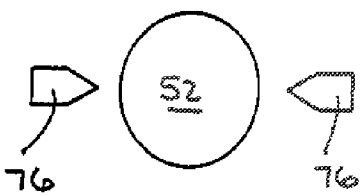
FIG. 3 is an end view illustration of one arrangement of a portion of the apparatus according to the present invention, more particularly the power washing nozzles, and which may be used for practicing the method of the present invention.
Figure 4:
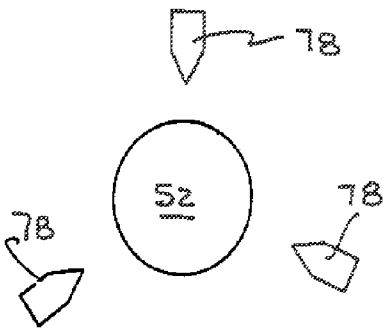
FIG. 4 is an end view illustration of another arrangement of a portion of the apparatus according to the present invention, more particularly the power washing nozzles, and which may be used for practicing the method of the present invention.

Power washer or sprayer 70 includes a plurality of nozzles. Thus, a pair of substantially diametrically opposed nozzles 76, as illustrated in FIG. 3 may be used. Alternatively, a plurality of nozzles 78 may be inwardly directed towards rod 52 at substantially evenly spaced 120 degree intervals around rod 52, as illustrated in FIG. 4. Thus, as rod 52 is being rotated and translated longitudinally by the series of pairs of offset rollers 28 through portion 50 of line 14 it is subjected to the high pressure water directed by nozzles 76 or 78 to power wash off the "fine hairs", as well as to clean the foreign residue.

As will be apparent from the foregoing description, and the illustration of FIG. 2, the present invention also provides an apparatus for practicing a method for further improving corrosion resistance of chrome plated material. Thus, rod 52 to be chrome plated, is subjected to a step of power washing with a high-pressure liquid, using sprayer nozzles, such as 76 or 78, intermediate the last abrasive polishing station 62 of rod 52 and reverse etching station 74. The high-pressure power wash not only facilitates the removal of foreign residue from the abrasive polishing step, but also blows or blasts off filaments or "fine hairs" of the material itself. Thus, the microcavities or pockets which would be created during reverse etching at sites of the "fine hairs" are substantially decreased resulting in a better, more corrosion resistant chrome plated material. After power washing, rod 52 may also be immersed in a caustic solution for cleaning and subsequent immersion rinses before the reverse etching step.

The foregoing description and drawings merely explain and illustrate the invention and the invention is not limited thereto except insofar as the appended claims are so limited, as those skilled in the art who have the disclosure before them will be able to make modifications or variations therein without departing from the scope of the invention.

The invention claimed is:

1. An apparatus for improving the corrosion resistance of chrome plated materials comprising:

a line for receiving and processing materials to be chrome plated;

the line having at a position therealong, an entrance at one, entrance end, and an exit at another, exit end, opposed to the one entrance end;

a mechanism for moving the received materials to be chrome plated along the line from the one entrance end to the other exit end during processing;

at least one mechanical device intermediate the one entrance end and the other exit end for abrasively polishing the materials to be chrome plated to a finish which leaves integral strands, filaments or "fine hairs" of microscopic size attached;

at least one station intermediate the at least one mechanical device and the other exit end for plating the materials to be chrome plated;

at least one high-pressure liquid sprayer for removing the attached microscopic size integral strands, filaments or "fine hairs" of the materials to be chrome plated intermediate the at least one mechanical device and the at least one station for plating the materials to be chrome plated;

an applicator, intermediate the at least one station for plating the materials to be chrome plated and the other exit end, for applying a non-thermosetting buffing compound to the chrome plated materials by spraying it onto the chrome plated materials, without prior heat treatment of the chrome plated materials;

a heater for heating the chrome plated materials after applying the buffing compound; and at least one buffer for buffing the heated chrome plated materials after the buffing compound has been both applied and heated.

2. The apparatus according to claim 1 in which the at least one station for plating the materials to be chrome plated is a reverse etching station.

3. The apparatus according to claim 2 including at least one caustic solution station for treating the materials to be chrome plated, positioned intermediate the at least one high-pressure liquid washer and the reverse etching station as the materials to be chrome plated move from the one entrance end to the other exit end.

4. The apparatus according to claim 1 in which the liquid is water.

5. The apparatus according to claim 1 in which the pressure is greater than 100 psi.

6. The apparatus according to claim 1 in which the pressure is in the range of 1000 to 3000 psi.

7. The apparatus according to claim 1 in which the pressure is in the range of 2500 to 3000 psi.

8. The apparatus according to claim 1 in which the at least one high-pressure liquid sprayer has a pair of opposed nozzles that are directed towards each other.

9. The apparatus according to claim 1 in which at least one high-pressure liquid sprayer has a plurality of nozzles that are inwardly directed towards the materials to be chrome plated.

* * * * *